United States Patent [19]

Paul et al.

[11] Patent Number: 4,568,260

[45] Date of Patent: Feb. 4, 1986

[54] BRICK TEXTURING SYSTEM

[75] Inventors: Roger Paul, Malvern; Larry Dixon, Hot Springs; Mitchell Goodger, Malvern, all of Ark.; Roland H. Adams, Garland, Tex.

[73] Assignee: Acme Brick Company, Fort Worth, Tex.

[21] Appl. No.: 561,691

[22] Filed: Dec. 15, 1983

[51] Int. Cl.[4] ..... B28B 11/08

[52] U.S. Cl. ..... 425/106; 264/293; 425/297; 425/304; 425/385

[58] Field of Search ..... 425/385, 304, 307, 296, 425/297, 104, 106; 264/293, 162

[56] References Cited

U.S. PATENT DOCUMENTS

| | | | |
|---|---|---|---|
| 1,193,871 | 8/1916 | Butterworth | 425/385 |
| 1,514,632 | 11/1924 | Ruby | 425/385 |
| 1,543,425 | 6/1925 | Cristiani | 425/385 |
| 1,580,154 | 4/1926 | Neher | 425/385 |
| 2,146,957 | 2/1939 | Jones | 425/385 |
| 2,588,595 | 3/1952 | Warner | 425/385 |
| 2,778,086 | 1/1957 | Wilcox | 425/385 |
| 3,754,850 | 8/1973 | Pate | 425/385 |
| 3,771,932 | 11/1973 | Van Daal | 425/385 |
| 4,147,419 | 4/1979 | Postell, Jr. | 425/385 |
| 4,419,065 | 12/1983 | Cox | 264/157 |

*Primary Examiner*—Jay H. Woo
*Assistant Examiner*—James C. Housel
*Attorney, Agent, or Firm*—Stanley R. Moore; Thomas L. Crisman

[57] ABSTRACT

A texturing system for brick fabrication comprising a plurality of slapping members mounted to at least one transmission belt for engaging individual edges of bricks within an array of bricks. The bricks are positioned beneath the slapping members while in a deformable state. An array of staggered lifting plates are positioned beneath the bricks for exposing opposite edge portions thereof to the slapping elements. The transmission belt is driven transversely to the movement of the bricks array for imparting the texturing force of the slapping elements to the underlying bricks along upstanding edge portions thereof. A series of three transmission belts are preferably used above a staggered pattern of two plate rows for treating the longitudinal sides of all bricks within an array. In this manner, an improved rough, used brick appearance may be imparted to individual brick elements while disposed in a common fabrication array.

11 Claims, 4 Drawing Figures

BRICK TEXTURING SYSTEM

BACKGROUND OF THE INVENTION

1. Field of the Invention

The present invention relates to brick texturing systems and, more particularly, to a brick texturing unit for indenting the edges of individual bricks.

2. History of the Prior Art

The fabrication of brick from materials such as clay is an ancient art. Conventional fabrication techniques have improved both the speed at which such product can be produced as well as the structural and aesthetic characteristics. Innovations in material preparation, cutting, handling, and curing have allowed brick manufactures to produce the bricks in mass arrays. Treatment of the faces of the brick for aesthetic purposes is likewise afforded by conventional texturing systems which treat an array of brick simultaneously during manufacture.

Numerous prior art systems are conventionally available for texturing the surface of a brick array. Many of these systems incorporate rollers, brushes, and belts to impart rough, pitted, and chipped features to the brick. These features impart a used appearance to the goods which is deemed highly desirable in certain construction applications. Brick fabrication technology has been effective for many years, and older bricks are generally structurally sound. For this reason the use of second hand bricks, of the type removed from previous structures, has become feasible and a contemporary building design consideration. The cost of actual used bricks is, however, prohibitive in many instances. For obvious reasons, the availability of such "used" product is limited. The application of texturing systems for new brick has thus found a wide range of acceptance. Moreover, technology for producing a more realistic used look in brick has found large demand. One prior art approach to the texturing of the face and side edges of brick is set forth and shown in U.S. Pat. No. 2,778,086 to Wilcox. The Wilcox patent shows a system for texturing a column of clay as it issues from extrusion apparatus. The textural lines are formed by brushes carried on an endless belt which engages the clay ribbon. The material is thus scored in such a way as to impart certain desirable characteristics. An earlier version of this method is set forth and shown in U.S. Pat. No. 1,580,154 to Neher. The Neher patent teaches the use of scoring pins which engage the face of the brick ribbon. The scored surface is then rolled to impart the desirable aesthetic quality.

Other prior art approaches utilize rotating brushes such as that shown in U.S. Pat. No. 1,193,871 to Butterworth. This 1916 reference teaches the treatment of a clay-ribbon into a roughened configuration without having predominating lines extending in any one direction. The system incorporates a series of rotatable brushes having resilient bristles of steel or the like for pitting the surface of the brick ribbon rather than scoring it. The brushes are so mounted that their engagement with the ribbon is controlled by resilient means for presenting the pitted configuration. This prior art approach illustrates the desirability of the non-uniform, non-directional pattern which has been found desirable in brick texturing systems.

It may be seen in these prior art references that the brick texturing systems engage and treat the planar surfaces of the brick ribbon. While an aesthetically pleasing texture may be imparted to this flat surface, the edges of the individual bricks are themselves left unaffected due to the planar configuration of the brick array in the ribbon state. Actual used brick has an appearance which is multi-dimensional and extends beyond the planar surface of the brick itself. Generally, such bricks are chipped, dented, and/or deformed along the edge portions as a result of normal environmental wear or their removal. Therefore, the treatment of just the generally flat exposed surface of the brick is in and of itself an incomplete texturing operation. Prior art methods and apparatus for texturing brick ribbons do not affect such edge surfaces due to the co-planar relationship of the brick edges with the clay ribbon. Another consideration is the configuration of the texturing device itself relative to the ribbon. When such edge deformation is needed, the bricks are sometimes individually handled to impart the requisite aesthetic characteristics. Manual brick handling operations are obviously not conducive to high production fabrication and are inherently expensive.

It would be an advantage, therefore, to provide a brick texturing system for treating the edges of the individual bricks while the bricks remain in the production array. The methods and apparatus of the present invention provide such a system wherein the individual bricks of a production array are exposed to an edge texturing unit. Deformation of the edge of the brick is effected by positioning the issuing brick ribbon over an array of staggered lifting plates which underlie the bricks passing thereacross. A plurality of oppositely directed slapping members then engage the exposed edges of the respective bricks passing therethrough. In this manner, a rough, used brick appearance is imparted to the individual brick elements which remain in the production array.

SUMMARY OF THE INVENTION

The present invention relates to a texturing system for brick fabrication comprising means for deforming the edges of bricks disposed within an array. More particularly, one aspect of the invention includes an improved system for the texturing of bricks of the type wherein the surface of the brick is deformed while disposed within an array issuing from a forming mold. The improvement comprises a frame secured above the array of bricks issuing from the forming mold. Means disposed beneath the frame lift individual ones of the bricks upwardly for exposing edge portions thereof toward the frame. Means mounted to the frame then engage and deform the exposed edges of the bricks positioned thereunder.

In another aspect, the invention includes the aforesaid texturing apparatus wherein the deforming means comprises at least one endless belt having a plurality of slapping elements mounted thereto and extending therefrom. The elements are positioned for engagement of the exposed edge portions of the brick passing relative thereto. The frame further includes means for driving the belt continuously over the bricks issuing thereunder. The lifting means comprises a plurality of plates secured in a staggered array beneath the frame for underlying select ones of the bricks in the array for producing a staggered array of bricks with edges of each exposed to the deforming means mounted to the frame.

In another aspect, the invention includes the aforesaid texturing apparatus wherein the means for deforming the edges of the bricks comprises at least one conveyor belt having a plurality of slapping elements extending therefrom for engaging the exposed edges of the bricks passing thereunder. The lifting means comprises a plurality of plates secured in a staggered array beneath the slapping elements. The plates lift opposite ones of a staggered array of the bricks into engagement with the slapping elements for deforming the edge portions thereof while the brick array passes therethrough.

In yet another aspect, the invention includes an improved method of texturing bricks of the type wherein a ribbon of clay is extruded from a mold, cut into a plurality of brick elements, and the surface of the brick elements deformed into a textured configuration. The method is effected while the bricks are disposed within a production array. The improvement comprises providing means for lifting adjacent ones of the bricks forming the array to expose the edge portion thereof. Means are provided then for engaging and deforming the exposed sections of the brick array in the lifted configurations. The lifting means and the deforming means are positioned about a section of the issuing clay ribbon for engagement therewith. The ribbon of clay comprising the brick array issues over the lifting means while the exposed edges of the bricks upstanding from the lifting means are deformed.

BRIEF DESCRIPTION OF THE DRAWINGS

For a more complete understanding of the present invention and for further objects and advantages thereof, reference may now be had to the following description taken in conjunction with the accompanying drawing in which.

DETAILED DESCRIPTION OF THE PREFERRED EMBODIMENT

Figure 1:
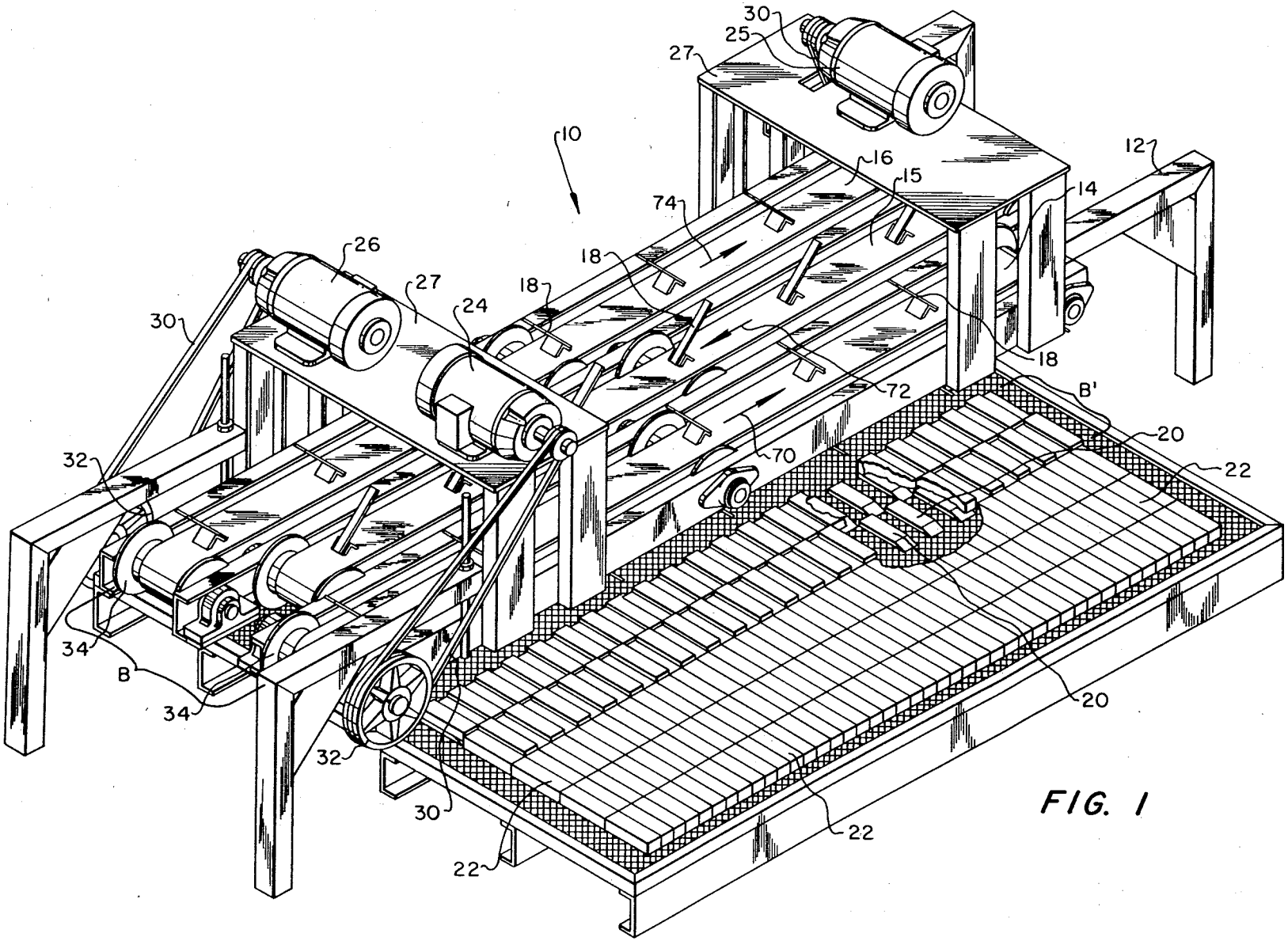
FIG. 1 is a perspective view of one embodiment of a brick texturing system constructed in accordance with the principles of the present invention.

Referring first to FIG. 1, there is shown a preferred embodiment of a system constructed in accordance with the principles of the present invention for texturing an array of bricks. The system 10 comprises a frame 12 supporting multiple conveyor belts 14, 15 and 16 from which extend elongated, flexible slapping elements 18. Beneath the conveyor belts 14, 15 and 16 lies a staggered array of lifting plates 20 which underlie and support opposite ones of adjacent bricks 22 passing thereover and beneath the belts 14, 15 and 16. Rotation of the belts 14, 15 and 16 causes the slapping elements 18 to strike edge portions of the brick exposed thereto by the underlying staggered array of lifting plates 29. Movement of the brick array through the frame 12 then results in a random pattern of edge deformations imparted to the bricks 22, in the manner discussed in more detail below.

Still referring to FIG. 1, the frame 12 comprises an elongate structure disposed transversely to the bricks 22 passing thereunder. Drive motors 24, 25 and 26 are provided for powering the slapping action of the belts. Each motor upstands from the frame 12 and is secured thereto by a platform 27 from which a drive belt 30 couples a pulley 32. Each pulley 32 is connected to a belt drive 34 for driving the respective belts 14, 15 and 16 in opposite directions relative to one another. As each belt rotates about the belt drive 34, the slapping elements 18 made of rubber, or the like, sequentially engage the particular brick edge exposed thereto. The orthogonal movement of each bricks 22 relative to the belts 14, 15 and 16 exposes entire edge portions to the slapping and deforming action. With adjacent the ones of belts moving in opposite directions both edges of the brick are substantially engaged in a manner discussed in more detail below.

Figure 2:
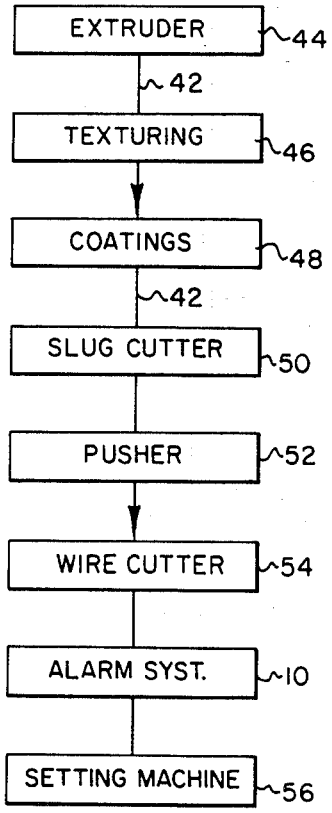
FIG. 2 is a block diagram of a process flow chart illustrating the fabrication and texturing of bricks in accordance with the principles of the present invention.

Referring now to FIG. 2, there is shown a block diagram of a process flow chart 40 illustrating the fabrication and texturing of bricks 22 in accordance with the principles of the present invention. A clay ribbon 42, first issues from an extruding unit 44 and travels to a texturing unit 46 where the planar brick faces are imparted with conventional aesthetic qualities as discussed above. The textured ribbon 42 is then preferably coated with sand, oxides, or the like in coating unit 48 for adding color thereto. The ribbon 42 is subsequently cut into wide sections, or "slugs" in a conventional slug cutting system 50. The longitudinal slugs are moved laterally by a pusher system 52 through a wire cutter 54 wherein the individual bricks 22 are therein defined. The individual bricks 22 issuing from cutter 54 are aligned in a co-planar array and presented to the texturing system 10 of the present invention for edge deformation. A setting machine 56 may next sets the textured bricks 22 into sections for stacking.

Figure 3:
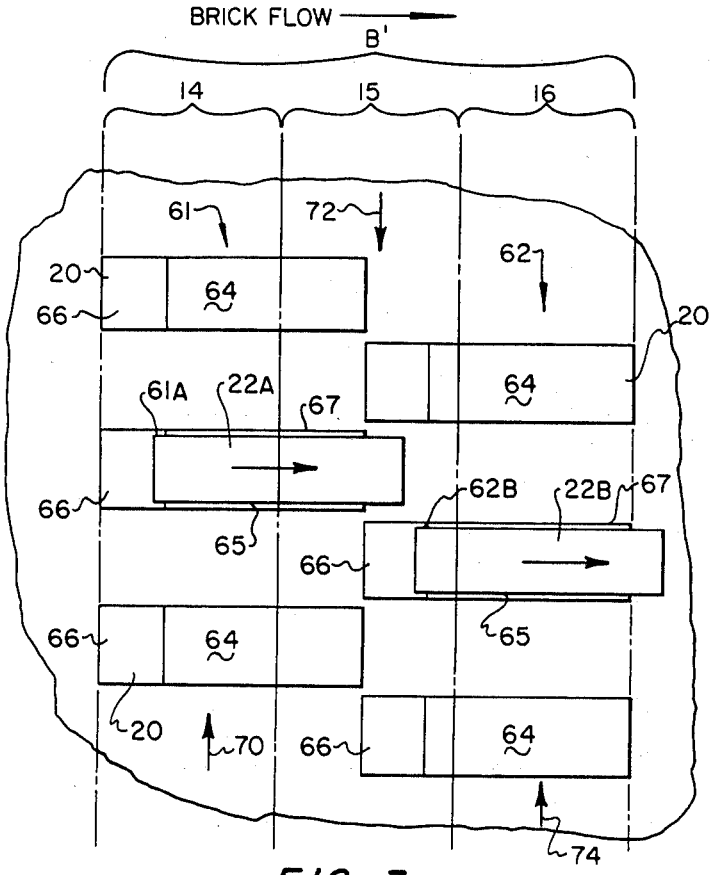
FIG. 3 is a top-plan view of a portion of the array of lifters disposed beneath the zones of the texturing belt shown in FIG. 1.

Referring now to FIG. 3, there is shown an array of lifting plates 20 of the type disposed beneath the belts 14, 15 and 16 of FIG. 1. The plates 20 are aligned in a first staggered row of plates 61 and a second staggered row of plates 62 disposed therebetween and downstream thereof relative to the brick flow of the present invention. Each lifting plate of rows 61 and 62, is preferably formed of stainless steel or the like, and includes a generally horizontal co-planar region 64 for supporting a brick disposed thereupon. Likewise, each row of lifting plate 61 and 62 includes a frontal inclined area 66 for engaging the leading edge of individual bricks 22 and positioning it, upon the respective lifting plate. Each plate is approximately the length of one brick 22 being treated. In this manner, an array of bricks 22 moving over the lifting array 20 will manifest a staggered vertical positioning of opposite ones of adjacent bricks 22. In other words, every other brick in both a lateral and horziontal direction will upstand from the array and be exposed to the three zones of the flexible slapping elements 18 of belts 14, 15 and 16. The plates 20 will, of course, need to lie substantially beneath said zones. This requires the plates 20 to be no longer than the length of a single brick 22, and together equal to the width of said combined belt zone "B". For purposes of example only, belts 14, 15 and 16 may each be constructed of 4 inch widths and disposed side by side to cover an area B of engagement approximately 20½ inches wide. In this configuration, each plate would be about 10¼ inches long as would be each brick 22 for extending a combined distance B′ of 20½ beneath the frame 12.

As shown in FIG. 3, the bricks 22 move through the lifting array 20 and are engaged on opposite longitudinal sides by the slapping elements 18 within the belt zones 14, 15 and 16. Various arrangements of the lifting plates and belt drive sequences may, of course, be provided. However, in the present invention, belt zone 14 illustrates a belt and slapping elements 18 moving upwardly relative to FIG. 3 as indicated by arrow 70. Belt 15 is shown to be moving downwardly relatively to FIG. 3 as shown by arrow 72 and belt 16 is shown to be moving upwardly relative to FIG. 3 as shown by arrow 74. By positioning the two staggered plate rows 61 and 62 of plates 20 under the three belt zones, each brick 22 is textured on opposite sides. For example, a brick 22A moving upon a plate 61A will first engage slapping elements 18 moving in direction 70, which encompasses one edge region 65. The same brick 22A also engages slapping elements 18 moving in direction 72 on the opposite edge 67 before it slides off of the end of plate 61A and beneath said slapping elements. Simultaneously therewith, another adjacent brick 22B rides upon plates 62B exposing edge region 67 to slapping elements 18 moving in direction 72. Continued movement of brick 22B upon plate 62B exposes edge region 65 to slapping elements 18 of belt 16 moving in direction 74. The dual staggered lifting plates 20 disposed beneath the triple, oppositely directed belt units 14, 15 and 16 thus deform opposite edges of each brick 22 of the common array passing therethrough in accordance with the present invention.

Figure 4:
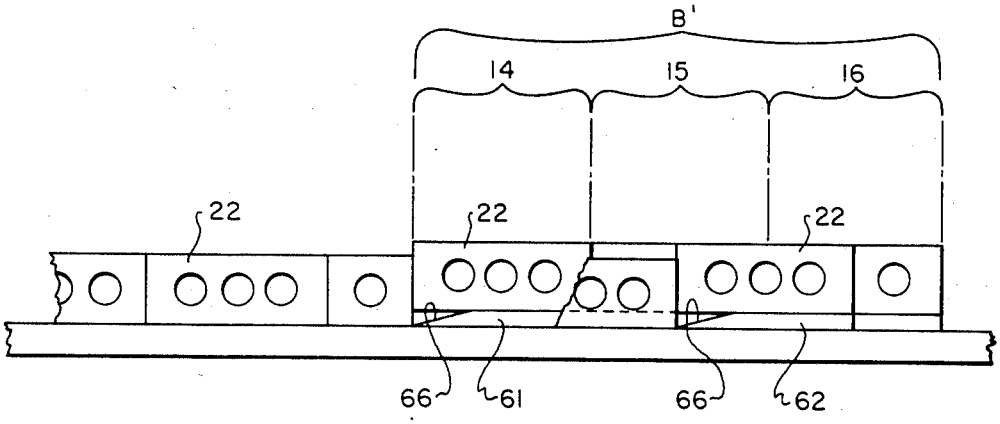
FIG. 4 is a side-elevational view of a portion of the lifter array of FIG. 3.

Referring now to FIG. 4 there is shown a side elevational view of the lifter array 20 of FIG. 3 discussed above. As shown in the array of FIG. 3, lifting plates 61 provides an inclined leading edge 66 upon which bricks 22 are urged upwardly. The generally horizontal portion 64 of each plate supports the uplifted and exposed brick during the movement beneath the frame 12. Each lifting plate 20 is sufficiently long to expose at least one brick 22 moving thereacross to repeated engagement with slappers 18 from the respective belts. The three exposure zones for the respective belts 14, 15 and 16 are shown in phantom in FIGS. 3 and 4 for purposes of clarity. Because of the slapper elements 18 are disposed in staggered positions along each of the respective belts 14, 15 and 16, the brick edges exposed thereto will be efficiently engaged substantially therealong. Moreover, the staggered positioning of the lifting plates 20 relative to the opposite belt movements 70, 72 and 74, permit the desired aesthetic configuration set forth herein in an automated fashion upon bricks 22 remaining with the array.

It is thus believed that the operation and construction of the present invention will be apparent from the foregoing description. While the method and apparatus shown and described has been characteristized as being preferred, it will be obvious that various changes and modifications may be made therein without departing from the spirit and scope of the invention as defined in the following claims.

I claim:

1. An improved system for texturing bricks wherein the surface of a brick is deformed while disposed within an array issuing from a forming mold, wherein the improvement comprises:

a frame mounted above said array of bricks issuing from said forming mold adapted for the passage of said brick array thereunder in a direction generally transverse thereto;

means disposed beneath said frame for lifting individual ones of said bricks upwardly for exposing longitudinal edge portions thereof toward said frame;

means mounted to said frame for engaging and deforming said exposed edges of said bricks passing thereunder;

said deforming means comprising at least two endless belts having a plurality of slapping elements mounted thereto, extending therefrom, and positioned for engagement with the exposed edge portions of said bricks passing thereunder, said belts moving generally transversely to said brick array passing thereunder and in opposite directions relative to each other for deforming opposite longitudinal edge portions of said bricks; and said lifting means comprising a plurality of plates secured in a staggered array beneath said frame for firstly underlying a first group of said bricks in said array to produce an upstanding array of bricks with longitudinal edges of each exposed to a first one of said endless belts mounted to said frame and secondly underlying a second group of said bricks in said array to produce an upstanding array of bricks with longitudinal edges of each exposed to a second of said endless belts, moving in an opposite direction relative to said first belt.

2. The apparatus as set forth in claim 1 wherein said frame further includes means for driving said belts continuously and in opposite directions over said bricks issuing thereunder.

3. The apparatus as set forth in claim 1 wherein each of said plates of said staggered array includes an angulated frontal section adapted for engaging and lifting an edge of a brick passing thereover while said brick array issues thereacross.

4. The apparatus as set forth in claim 1 wherein said deforming means comprises at least three conveyor belts having a plurality of slapping elements extending therefrom, each belt moving in an opposite direction relative to an adjacent belt for engaging oppositely exposed edges of said upstanding array of said bricks passing thereunder, and wherein said staggered array of plates secured beneath said slapping elements are aligned into two row patterns for lifting opposite ones of adjacent bricks of said array into engagement with a first of said belts of slapping elements and a second of said belts of slapping elements for deforming the edge portions thereof while said brick array passes therethrough whereby said opposite edges of said bricks not exposed to a first of said three belts by a first of said two row patterns of plates are exposed to oppositely moving slapping elements of a second and third of said three belts for deforming said exposed edges of said bricks.

5. The apparatus as set forth in claim 4 wherein said plates each include an angulated frontal section adapted for engaging and lifting an edge of a brick passing thereover and wherein each row pattern of plates lies beneath at least two of said endless belts for exposing opposite edges of bricks issuing thereover to said slapping elements.

6. The apparatus as set forth in claim 5 wherein said array of plates comprises a staggered array and each of said plates is of a substantially equivalent width to each of said bricks for lifting and supporting said brick upwardly relative to contiguous bricks within said array and under said frame.

7. A system for brick fabrication from a ribbon of clay comprising:

an extruding unit for issuing a ribbon of clay therefrom;

a texturing unit disposed adjacent said extruding unit for treating a surface of said ribbon;

means for coating said ribbon issuing from said texturing unit;

means for dividing said ribbon issuing from said texturing unit into slugs;

means for cutting individual bricks from said slugs into brick arrays;

means for lifting individual ones of said bricks issuing from said cutting means upwardly for exposing longitudinal edge portions thereof relative to contiguous bricks; and means disposed above said lifting means for engaging and deforming said exposed edges of said bricks upstanding thereunder;

said deforming means comprising at least two endless belts having a plurality of slapping elements mounted thereto, extending therefrom, and positioned for engagement with the exposed edge portions of said bricks passing thereunder, said belts generally transversely to said brick array passing thereunder and moving in opposite directions relative to each other for deforming opposite longitudinal edgeportions of said bricks; and said lifting means comprising a plurality of plates secured in a staggered array beneath said frame for firstly underlying a first group of said bricks in said array to produce an upstanding array of bricks with longitudinal edges of each exposed to a first one of said endless belts mounted to said frame and secondly underlying a second group of said bricks in said array to produce an upstanding array of bricks with longitudinal edges of each exposed to a second of said endless belts, moving in an opposite direction relative to said first belt.

8. The apparatus as set forth in claim 7 wherein said frame further includes means for driving said belts continuously and in opposite directions over said bricks issuing thereunder.

9. The apparatus as set forth in claim 7 wherein said lifting means comprises a plurality of plates secured in a staggered array beneath said deforming means for underlying select ones of said bricks in said array and producing an upstanding array of bricks with edges of each exposed to said deforming means mounted thereabove.

10. The apparatus as set forth in claim 7 wherein each of said plates of said staggered array includes an angulated frontal section adapted for engaging and lifting an edge of a brick passing thereover while said array issues thereacross.

11. The apparatus as set forth in claim 7 wherein said deforming means comprises at least three conveyor belts having a plurality of slapping elements extending therefrom, each belt moving in an opposite direction relative to an adjacent belt for engaging oppositely exposed edges of said upstanding array of said bricks passing thereunder, and wherein said staggered array of plates secured beneath said slapping elements are aligned into two row patterns for lifting opposite ones of adjacent bricks of said array into engagement with a first of said belts of slapping elements and a second of said belts of slapping elements for deforming the edge portions thereof while said brick array passes therethrough whereby said opposite edges of said bricks not exposed to a first of said three belts by a first of said two row patterns of plates are exposed to oppositely moving slapping elements of a second and third of said three belts for deforming said exposed edges of said bricks.

* * * * *